US007578299B2

(12) United States Patent
Ra

(10) Patent No.: US 7,578,299 B2
(45) Date of Patent: Aug. 25, 2009

(54) GREEN TEA-BASED SUBSTITUTE FOR CIGARETTE AND METHOD FOR MANUFACTURING THE SAME

(75) Inventor: Chan-Ha Ra, Pyeongtaek (KR)

(73) Assignee: Dream Ciga Tec Co., Ltd., Seoul (KR)

( * ) Notice: Subject to any disclaimer, the term of this patent is extended or adjusted under 35 U.S.C. 154(b) by 743 days.

(21) Appl. No.: 11/246,664

(22) Filed: Oct. 11, 2005

(65) Prior Publication Data

US 2007/0023060 A1 Feb. 1, 2007

(30) Foreign Application Priority Data

Jul. 26, 2005 (KR) ..... 10-2005-0068077

(51) Int. Cl.
*A24B 15/16* (2006.01)
*A24B 3/12* (2006.01)

(52) U.S. Cl. ..... 131/359; 131/300

(58) Field of Classification Search ..... 131/359, 131/300

See application file for complete search history.

(56) References Cited

U.S. PATENT DOCUMENTS 6,619,293 B1 * 9/2003 Siadto ..... 131/369

* cited by examiner

*Primary Examiner*—Philip C Tucker
*Assistant Examiner*—Michael J Felton
(74) *Attorney, Agent, or Firm*—Birch, Stewart, Kolasch & Birch, LLP

(57) ABSTRACT

A green tea-based cigarette is made from a blend comprising 60-70 wt % of dry green tea leaves, each being 1-5 mm in width and 5-15 mm in length, as a main component, 25-35 wt % of cut dry tobacco leaves, and 3-7 wt % of tobacco spice; a blend comprising 80-90 wt % of the cut dry green tea leaves, 5-15 wt % of cinnamon powder and 3-7 wt % of tobacco spice; or a blend comprising 93-97 wt % of cinnamon-infused cut dry green tea leaves which are obtained by soaking 80-90 wt % of the cut dry green tea leaves in a cinnamon extract solution, and 3-7 wt % of tobacco spice. The cigarette gives flavor and tastes similar to those of conventional tobacco, catering to conventional smokers' tastes.

11 Claims, No Drawings

GREEN TEA-BASED SUBSTITUTE FOR CIGARETTE AND METHOD FOR MANUFACTURING THE SAME

BACKGROUND OF THE INVENTION

1. Field of the Invention

The present invention relates, in general, to green tea-based cigarettes and a method for manufacturing the same. More particularly, the present invention relates to green tea based cigarettes made from green tea leaves in combination with tobacco leaves or cinnamon, which provide tastes and flavors similar to those of conventional tobacco, or novel mild and fresh tastes and flavors, to smokers, with little or no toxicity thanks to the neutralization effects of the advantageous green tea ingredients epigallocatechin gallate(EGCG), flavonoids, catechin, etc.

2. Description of the Related Art

With the progress of society to complexity, it is likely for people to encounter greater stress. People try to pursue new activities and substances to cope with stress. Since 1492, tobacco has been one of the favorite substances of people all over the world, playing a role as one of the coping mechanisms. With almost all persistent flavors determined mainly by its leaves, tobacco, however, contains as many as 4,000 kinds of toxic materials, particularly, nicotine and tar, which are known to be responsible for a variety of serious diseases in smokers. In spite of such serious harmfulness, governments of countries do not actively conduct campaigns against smoking due to the enormous tax revenue from tobacco, and smoking is a very difficult habit to break because of the powerful nicotine addiction. Thus, smokers are always in great peril from disease. In addition, the tobacco smoke that smokers blow from their cigarettes is known to cause the same serious diseases in non-smokers inhaling the smoke as in the smokers.

A puff of tobacco smoke that is absorbed into the body from the respiratory organ of a smoker contains a lot of small toxic particles consisting mainly of nicotine, tar, and carbon monoxide.

Nicotine, a representative toxic substance contained in cigarettes, is a colorless oily compound, an alkaloid found naturally throughout the tobacco plant, with a high concentration in the leaves. Nicotine is toxic enough to kill persons who intake its concentrated aqueous solution. Nicotine in each puff of inhaled tobacco smoke is rapidly absorbed through the lungs and delivered to the brain within seconds. The nicotine in a puff of tobacco smoke is absorbed into the body in an amount of 20-30 wt % based on the total weight of the nicotine if the smoke puff remains only within the mouth and in an amount of 70 wt % or higher if the smoke puff is inhaled into the lungs. Acting as a factor leading to the pleasant and habit-forming qualities of tobacco smoking, nicotine is pharmaceutically classified as an addictive drug of almost the same level as opium. Causing unpleasant withdrawal symptoms, nicotine leads to smoking every 30 to 40 min once smokers start smoking. In addition, nicotine has the pharmaceutical effect of stimulating the central nervous system, like amphetamine. However, nicotine and amphetamine, although both are light stimulants, cause various stimulation effects. For example, when inhaled, nicotine increases the resting heart rate by 15-20 beats/min, as well as blood pressure, causes faster breathing, and contracts blood vessels so that frequent blood pumping is required. Consequently, nicotine brings about serious problems in the cardiovascular system.

Tar is the resinous partially combusted particulate matter produced by the burning of tobacco in the act of smoking. Tar partially determines the characteristic flavors of cigarettes, and appears as a blackish brown substance when a puff of tobacco smoke is blown against white paper. Tar is purportedly the most destructive component in habitual tobacco smoking, accumulating in the smoker's lungs over time and damaging them through various biochemical and mechanical processes. Tar includes the majority of mutagenic and carcinogenic agents in tobacco smoke.

Carbon monoxide is also produced upon smoking and is a colorless, odorless gas, like exhaust gas from automobiles. Thus, a smoking person is like a person breathing fossil fuel exhaust. Carbon monoxide reduces the blood's ability to carry oxygen, causing smokers to suffer from chronic hypoxemia and symptoms of senility. The headache, dizziness and difficult breathing syndromes occurring when a person smokes heavily or stays for a long period of time in a space filled with tobacco smoke, are believed to result from the interruption of the blood's oxygen supply function by carbon monoxide.

Further, tobacco leaves packed within cigarette paper produce as many as about 4,000 toxic substances when burned at 800° C.

Conventionally, cigarettes are produced by cutting well dried tobacco leaves into thin strands, applying at least one of 599 spices to the cut tobacco leaves, wrapping cigarette paper around the tobacco in a machine, cutting the whole rod into lengths of 85-120 mm, making a cigarette rod, inserting a filter into the cigarette rod, and then wrapping tipping paper around the assembly.

As described above, conventional cigarettes made from tobacco plants produces about 4,000 toxic substances, including nicotine and many carcinogens, upon burning at about 800° C. when smoking. Also, smoking damages non-smokers around smokers in addition to the smokers themselves. In fact, the smoke that is inhaled by smokers is filtered to some degree through the filter attached to the cigarette, but the persons around smoking persons, even though they are non-smokers, are damaged more seriously because they inhale smoke which is not filtered, but generated directly from the burning portion of the cigarette.

Statistically, non-smokers have a 30% higher incidence of lung cancer and a 50% higher incidence of heart disease due to passive smoking than do their spouses who smoke. Their children are likely to suffer from acute respiratory diseases with a 5.7-fold higher incidence and from lung cancer with a 2-fold higher incidence than are the smokers. In addition to spoiling indoor air, tobacco smoke makes clothes smell disgusting.

Therefore, there is an imperative need for cigarettes that avoid the problems encountered in the prior arts and provide mild and fresh flavors and tastes to the smokers, with little or almost no bad effects of their smoke on the health of the smokers as well as that of secondhand smokers.

SUMMARY OF THE INVENTION

Accordingly, the present invention has been made keeping in mind the above problems occurring in the prior art, and an object of the present invention is to provide a cigarette which is harmless or healthful to the smoker as well as secondhand smokers, in addition to providing new fresh, mild tastes and flavors.

Another object of the present invention is to provide a method for manufacturing such a cigarette.

In order to accomplish the above object, the present invention provides a cigarette made from a blend comprising 60-70% by weight of cut dry green tea leaves, each being 1-5 mm in width and 5-15 mm in length, as a main component, and 25-35% by weight of cut dry tobacco leaves, each being 1-5 mm in width and 5-15 mm in length, and 3-7% by weight of tobacco spice as minor components; a blend comprising 80-90% by weight of cut dry green tea leaves, each being 1-5 mm in width and 5-15 mm in length, as a main component, and 5-15% by weight of cinnamon powder and 3-7% by weight of tobacco spice, both as minor components; or a blend comprising 93-97 wt % of cinnamon-infused cut dry green tea leaves, as a main component, which are obtained by soaking 80-90 wt % of the cut dry green tea leaves in a cinnamon extract solution, and 3-7 wt % of tobacco spice as a minor component.

The green tea-based cigarettes can be manufactured by a method comprising: a process of gathering tobacco leaves and green tea leaves; a sterilizing process in which the tobacco leaves are boiled twice in water, steamed once and dried under the sun, and the green tea leaves are toasted at 200° C. or higher for 10 min or longer in a kettle without oil or water; a primary drying process in which the sterilized tobacco leaves are dried in a sunny place until they turn brown, and the toasted green tea leaves are dried for three days in a hot air blower, boiled once and steamed once to reduce their odor by half or more; a cutting process in which the primarily dried tobacco leaves and green tea leaves are cut into strands, each having a size from 1 to 5 mm wide and 5 to 15 mm long, using different cutters; a blending process in which 60 to 70% by weight of the strands of green tea leaves as a main component, and 25 to 35% by weight of the strands of tobacco leaves and 3 to 7% by weight of tobacco spice, both as minor components, are fed into a blender and blended for 10 min or longer; a secondary drying process in which the blend comprising the green tea leaves, the tobacco leaves and the tobacco spice is dried for an additional three days in a hot air blower; a packing process in which the dried blend is delivered by a feed system to cigarette making machines, fed into hoppers which continuously allow measured amounts of filler to drop down on to prepared cigarette paper, and wrapped with the paper to form continuous rods which are then cut to proper lengths from 83 to 125 mm, filters are sealed to ends of cigarette rods with tipping paper, and packer machines insert cigarettes into packs which are then wrapped with cellophane sheets, or a method comprising: a gathering process in which bark peeled off cinnamon trees is cut into a size from 30 to 50 mm and leaves are selected from green tea plants; a sterilizing process in which the cinnamon bark is dried under the sun and the raw green tea leaves are toasted at 200° C. or higher for 10 min or longer; a primary drying process in which the sterilized cinnamon is dehydrated in a sunny place to a moisture content of 13% or less and the toasted green tea leaves are dried for three days in a hot air blower, boiled once and steamed once to reduce their odor by half or more; a cutting and grinding process in which the primarily dried green tea leaves are cut into strands, each having a size from 1 to 5 mm wide and 5 to 15 mm long, using a cutter, and the primarily dried cinnamon bark is ground using a grinder to afford powder; a blending process in which 80 to 90% by weight of the strands of green tea leaves, 5 to 15% by weight of the cinnamon powder, and 3 to 7% by weight of tobacco spice are blended in a blender; a secondary drying process in which the blend comprising the green tea leaves, the cinnamon powder and the tobacco spice is dried for an additional three days in a hot air blower; and a packing process in which the dried blend is delivered by a feed system to cigarette making machines, fed into hoppers which continuously allow measured amounts of filler to drop down on to prepared cigarette paper, and wrapped with the paper to form continuous rods which are then cut to proper lengths from 83 to 125 mm, filters are sealed to ends of cigarette rods with tipping paper, and packer machines insert cigarettes into packs which are then wrapped with cellophane sheets, or a method comprising: a gathering process in which bark peeled off cinnamon trees is cut into a size from 30 to 50 mm and leaves are selected from green tea plants; a sterilizing process in which a mixture of 10% by weight of the cinnamon bark strips and 90% by weight of water is boiled to produce an extract concentrate whose total amount is 5 to 15% by weight of the mixture, and the raw green tea leaves are toasted at 200° C. or higher for 10 min or longer in a kettle; a primary drying and steaming process in which the toasted green tea leaves are dried for three days in a hot air blower, boiled once and steamed once to reduce their odor by half or more; a cutting process in which the primarily dried green tea leaves are cut into strands, each having a size from 1 to 5 mm wide and 5 to 15 mm long, using a cutter; a blending process in which 80 to 90% by weight of the strands of green tea leaves is soaked in 5 to 15% by weight of the cinnamon extract concentrate to infuse the ingredients and flavor of cinnamon into the green tea leaves, and a formulation comprising 93 to 97% by weight of the cinnamon-soaked green tea leaves and 3 to 7% by weight of tobacco spice is fed into a blender and blended; a secondary drying process in which the blend comprising the green tea leaves infused with the flavor and ingredients of cinnamon, and the tobacco spice is dried for an additional three days in a hot air blower; a packing process in which the dried blend is delivered by a feed system to cigarette making machines, fed into hoppers which continuously allow measured amounts of filler to drop down on to prepared cigarette paper, and wrapped with the paper to form continuous rods which are then cut to proper lengths from 83 to 125 mm, filters are sealed to ends of cigarette rods with tipping paper, and packer machines insert cigarettes into packs which are then wrapped with cellophane sheets.

The cigarette gives flavor and tastes similar to those of conventional tobacco, catering to conventional smokers' tastes. Also, green tea leaves greatly attenuate the toxicity or neutralize the toxic substances nicotine and tar to almost harmless levels, in addition to providing refined flavors. The cigarette is almost harmless to the body thanks to its healthful components and provides sweet, peppery tastes upon burning, refreshing the smoker. The combined flavors and tastes of green tea and cinnamon are fresh to conventional smokers and can be pleasant even to non-smokers. In addition, the flavor of green tea has the effect of deodorization as well as repellency of harmful insects.

DESCRIPTION OF THE PREFERRED EMBODIMENTS

Green tea plants are native to Southeast Asia, but are today cultivated across the world, including Korea, China, Indonesia, Vietnam, Europe, South America, etc. Their flourishing leaves have a slightly bitter, astringent, and hot taste.

In accordance with the present invention, green tea leaves are used as main substances for cigarettes optionally with a minor amount of tobacco leaves. Upon burning, green tea leaves taste similar to tobacco leaves. When green tea leaves are used in combination with tobacco leaves in the cigarette of the present invention, the ingredients of green tea leaves, such as catechin, epigallocatechin gallate (EGCG), flavonoids, gallate, vitamins, etc., greatly attenuate the toxicity of the smoke of cigarettes or neutralize the toxic substances of tobacco leaves, such as nicotine, tar, etc., to almost harmless levels, in addition to providing refined flavors. In addition, the smoke of the green tea-based cigarettes according to the present invention shows an insect-repellent effect against various noxious insects, such as mosquitoes.

Ingredients of green tea and their physiological effects are summarized in Table 1, below.

TABLE 1

| Ingredients | Physiological Effects |
|---|---|
| Catechin | antioxidation, anti-mutation, Cancer prevention, hypocholesterolemic activity, antihypertension, hypoglycemic activity, platelet aggregation, antibacterial activity, anti-allergic activity |
| EGCG | Neuron protection, protection of nerve cells from oxidative stress |
| Flavonoids | Capillary solidification, antioxidation, hypotension, deodorization |
| Gallate | Anti-mutation, anti-tumor activity, anti-lipid peroxidative effect |
| Caffeine | stimulation of central nervous system, cardiotonic effect, anti-asthma action, hypermetabolism |
| Polysaccharides | Hypoglycemic activity, anti-diabetic activity |
| Vitamin C | Antiscorbutic effect, antioxidation, sterility prevention |
| Vitamin E | antioxidation, anti-cancer activity, immunopotentiation |
| Carotene | antioxidation, anti-cancer activity, immunopotentiation |
| Fluorine | Anti-tooth cavity |
| Zinc | Anti-dermatitis, immunopotentiation, anti-taste disorder |
| Selenium | antioxidation, anti-cancer activity, prevention of myocardial dysfunction |
| Manganese | antioxidation, co-enzyme factor, immunopotentiation |

As seen in Table 1, green tea leaves contain catechin, epigallocatechin gallate, flavonoids, gallate, caffeine, polysaccharides, vitamin C, vitamin E, carotene, fluorine, zinc, selenium, manganese, etc., with various advantageous effects, including antioxidation, anti-cancer activity, cholesterol reduction, reduction of blood pressure, antibacterial activity, neuron protection, deodorization, anti-mutation, anti-diabetic activity, immunopotentiation, etc.

Caffeine, one of the major ingredients of green tea, is odorless and bitter. The content of caffeine in green tea leaves increases when they are parched or panfried without water or oil compared to when they are steamed. Particularly, green tea leaves which are gathered at an early stage and/or grown in the shade are rich in caffeine. In contrast to coffee, green tea has no side effects from caffeine because polyphenols and vitamins of green tea leaves are associated with caffeine and remain insoluble in water at low temperatures so that the caffeine is slowly metabolized in the body.

Below, a detailed description will be given of cigarettes based on green tea in accordance with the present invention.

In a cigarette according to the present invention, a blend comprising cut dry green tea leaves, each 1-5 mm in width and 5-15 mm in length, as a main component in an amount from 60 to 70% by weight based on the total weight of the blend, and cut dry tobacco leaves, each 1-5 mm in width and 5-15 mm in length, and tobacco spice as minor components; a blend comprising cut dry green tea leaves, each 1-5 mm in width and 5-15 mm in length, as a main component in an amount from 80 to 90% by weight based on the total weight of the blend, and cinnamon powder and a tobacco spice as minor components; or a blend comprising cut dry green tea leaves soaked with a cinnamon extract solution as a main component in an amount from 93 to 97% by weight based on the total weight of the blend and a tobacco spice as a minor component, is wrapped with cigarette paper, with a filter inserted into one end of the cigarette paper.

As for the minor components in each formulation, they are different in composition and amount as understood above. In the case that tobacco leaves are used, the formulation comprises cut dry tobacco leaves in an amount from 25 to 35% by weight and tobacco spice in an amount of 3 to 7% by weight based on the total weight of the formulation. In the case of the cinnamon power, it is used in an amount from 5 to 15% by weight based on the total weight of the formulation, with the range from 3 to 7% by weight for tobacco spice. The cinnamon extract solution in which the tobacco leaves are soaked is prepared by boiling a mixture of 10% by weight of cinnamon bark and 90% by weight of water to the extent that the amount of the cinnamon solution is reduced to 5-15% of the weight of the original mixture. 80 to 90% by weight of the cut dry green tea leaves is mixed with 10 to 20% by weight of the cinnamon extract solution for 1 hour so that the green tea leaves are infused with the cinnamon flavor. Then, 93 to 97% by weight of the resulting cinnamon-soaked green tea leaves is combined with 3 to 7% by weight of a tobacco spice.

Any spice, if it used in conventional tobacco manufacture, may be used in the present invention. Preferable are hazelnut, mint, cacao, tobacco, and combinations thereof.

The reason why green tea leaves are cut into strands 1-5 mm wide and 5-15 mm long is that air may smoothly flow between strands of cut green tea leaves for the smoker to inhale the smoke without difficulty. When the strands of the cut green tea leaves are smaller than that size, not only is the combustion rate of the resulting cigarette lowered, but also the amount of smoke is decreased. Thus, the size ranging in width from 1 to 5 mm and in length from 5 to 15 mm prevents a decrease in the persistent burning of the cigarette.

Thus, in accordance with an embodiment of the present invention, a cigarette is made from a formulation comprising cut green tea leaves in an amount from 60 to 70% by weight, cut tobacco leaves in an amount from 25 to 35% by weight, and tobacco spice in an amount from 3 to 7% by weight. In this formulation, the content of the green tea leaves is far higher than that of the tobacco leaves, so that green tea flavors are predominant over tobacco flavors when the cigarette is burned. In addition to the flavor fed green tea leaves, the tobacco leaves are used to cater to the tastes of persons who smoke conventional tobacco. When the tobacco spice is used in an amount from 3 to 7% by weight based on the total weight of the formulation, a suitable, neither strong nor weak, intensity of its flavor can be provided to the cigarette. If the content of tobacco leaves is higher than that of green tea leaves, the smoker can enjoy neither the flavor of green tea leaves nor the their advantageous effects because the ingredients of the green tea leaves are overwhelmed by the noxious ingredients of the tobacco leaves.

In accordance with another embodiment of the present invention, a cigarette is made from a formulation comprising cut green tea leaves in an amount from 80 to 90% by weight, cinnamon powder in an amount from 5 to 15% by weight, and tobacco spice in an amount from 3 to 7% by weight, based on the total weight of the formulation. In this formulation, a more intense flavor of green tea leaves can be retained due to their higher content. In addition, the cinnamon powder enriches the taste of the cigarette, particularly for persons who prefer a hot taste. As described above, the amount of cinnamon power preferably falls into the range of 5 to 15% by weight based on the total weight of the formulation. For example, if the cinnamon powder is used in an amount less than 3% by weight, its flavor is too weak for the smoker to enjoy it. On the other hand, if the cinnamon powder is used in an amount greater than 15% by weight, its flavor is too strong for the smoker to enjoy the flavor of the green tea leaves. Thus, the formulation in accordance with the present invention enables the smoker to enjoy the flavors of both cinnamon and green tea.

In accordance with a further embodiment of the present invention, a cigarette is made from a formulation comprising cut dry green tea leaves soaked with a cinnamon extract solution in an amount from 93 to 97% by weight and tobacco spice in an amount from 3 to 7% by weight based on the total weight of the formulation. Upon the burning of the cigarette, the richer flavor and taste of cinnamon can be obtained when green tea leaves are soaked in a cinnamon extract solution compared to when green tea leaves are mixed with cinnamon powder because cinnamon particles are readily absorbed into the green tea leaves upon soaking. In the formulation, the smoker can enjoy the flavor and hot taste of cinnamon as well as the flavor of green tea, with pleasure. That is, the hot taste of cinnamon does not overwhelm the flavor of green tea and when the green tea leaves are dried after being soaked in the cinnamon extract solution, flavors of cinnamon and green tea can be readily exhaled.

Next, a method for manufacturing a cigarette based on green tea leaves is described in detail, according to embodiments.

The cigarette made from the formulation comprising green tea leaves, tobacco leaves and tobacco spice in accordance with the first embodiment of the present invention is prepared as follows.

$1^{st}$ Process (for Gathering Tobacco Leaves and Green Tea Leaves)

When harvesting tobacco leaves, the entire stalk is cut. Conversely, only leaves are selected from green tea plants.

$2^{nd}$ Process (Sterilization)

Tobacco leaves are twice boiled in water, once steamed, and dried under the sun.

Raw green tea leaves are toasted at 200° C. or higher for 10 min or longer in a kettle without oil or water. When toasted in a kettle heated to 200° C. or higher, green tea leaves can be sterilized, with the maximum retention of moisture and the savory and tender flavor of green tea.

$3^{rd}$ Process (Primary Drying)

The sterilized tobacco leaves are primarily dried in a sunny place until they turn brown. The toasted green tea leaves are primarily dried for three days in a hot air blower, boiled once and steamed once to reduce their odor by half or more.

$4^{th}$ Process (Cutting)

The primarily dried tobacco leaves and green tea leaves are cut into strands, each having a size from 1 to 5 mm wide and 5 to 15 mm long, using different cutters.

$5^{th}$ Process (Blending)

A formulation comprising 60 to 70% by weight of the strands of green tea leaves as a main component, and 25 to 35% by weight of the strands of tobacco leaves and 3 to 7% by weight of tobacco spice, both as minor components, is fed into a blender and blended for 10 min or longer.

By operating the blender for 10 min or longer, the components are thoroughly blended with each other, resulting in good provision of the flavor of each ingredient upon the burning of the cigarette.

$6^{th}$ Process (Secondary Drying)

The blend comprising the green tea leaves, the tobacco leaves and the tobacco spice is dried for an additional three days in a hot air blower.

$7^{th}$ Process (Packing)

The dried blend is delivered by a feed system to cigarette making machines called makers. At the maker, the blend is fed into hoppers which continuously drop measured amounts of filler on to prepared cigarette paper. The paper is wrapped around the tobacco blend and sealed to form continuous rods. These are then cut to proper lengths, e.g., from 83 to 125 mm. Filters are sealed to ends of cigarette rods with tipping paper. Packer machines insert cigarettes into packs which are then wrapped with cellophane sheets. Each of the cigarettes thus manufactured has the flavor of green tea leaves and tobacco leaves, enriched with tobacco spice.

In the first drying process, the nauseating grass odor of green tea leaves is removed by the hot air blower while the intense taste of green tea leaves is substantially reduced by the boiling and steaming processes to leave a sweet flavor.

In the third (primary drying) and the sixth (secondary drying) process, green tea leaves, or a blend of green tea leaves, tobacco leaves and tobacco spice, are preferably dried at 190° C. using a hot air blower.

Conventional cigarettes, which are based on tobacco leaves, are strong in taste. In contrast, the cigarettes made from green tea leaves supplemented with a small amount of tobacco leaves have new and mild flavors and tastes, with the retention of the flavor of conventional cigarettes, and are significantly reduced in toxicity due to the neutralization of nicotine and tar by the advantageous ingredients of green tea leaves, including epigallocatechin gallate, flavonoids, catechin, etc.

In a second embodiment of the present invention, cinnamon powder is added instead of the green tea leaves of the first embodiment.

Cinnamon, used as an herbal medicine, is a generic name for dried bark peeled from cinnamon roots, stalks, and stems, or dried, unpeeled cinnamon stems. Cinnamon, having a slightly hot and fresh taste, contains cinnamon oil, aldehyde, alcohols, acetic acid, tannin, mucous substances, carbohydrates, lipids, iron, vitamins A, B1 and B2, etc., which can be harmonize with the ingredients of green tea leaves. With the function of relieving the central nervous system, cinnamon is used as a sedative, a pain relief agent, and an antipyretic in herbal medicine. Cinnamon oil is aromatic and has the function of strengthening the stomach. In detail, cinnamon gently stimulates the stomach to promote the secretion of gastric juice and saliva, thereby helping digestion. In addition, cinnamon oil prevents the generation of gastric ulcers. Besides, cinnamon is known to have functions of increasing blood flow in the coronary arteries, radioactive resistance, and the number of leukocytes, and of inhibiting the growth of dermatophytes.

Therefore, cigarettes made from green tea leaves supplemented with cinnamon contain physiologically advantageous ingredients, so that smokers of the cigarettes inhale the advantageous ingredients while enjoying the taste similar to that of conventional cigarettes, which are entirely harmful to the body. The smoke generated directly from the burning portion of the cigarette in accordance with the second embodiment of the present invention is thus no longer harmful to secondhand smokers, that is, persons around the smoker. Further, when completely spread around a room, the green tea leaf smoke from the cigarette exhibits antibacterial activity, deodorization, aromatherapeutic effects, and repellency of harmful insects, such as mosquitoes.

The cigarette made from the formulation comprising green tea leaves, cinnamon and tobacco spice in accordance with the second embodiment of the present invention is prepared as follows.

1st Process (for Gathering Cinnamon and Green Tea Leaves)

Bark is peeled off cinnamon trees and cut into a size from 30 to 50 mm, which is suitable for subsequent grinding into fine powder in a grinder. Leaves are selected from green tea plants.

2nd Process (Sterilization)

Sterilization of the chopped cinnamon bark can be achieved by drying under the sun and for the raw green tea leaves by toasting at 200° C. or higher for 10 min or longer in a kettle without oil or water.

3rd Process (Primary Drying)

The sterilized cinnamon is dehydrated in a sunny place to a moisture content of 13% or less. Cinnamon bark with a moisture content of 13% is completely dry to the touch.

The toasted green tea leaves are primarily dried for three days in a hot air blower, boiled once and steamed once to reduce their odor by half or more. That is, 50% or more of the odor of green tea leaves is eliminated, along with vapor during boiling and steaming.

4th Process (Cutting and Grinding)

The primarily dried green tea leaves are cut into strands, each having a size from 1 to 5 mm wide and 5 to 15 mm long, using a cutter. The primarily dried cinnamon bark is ground using a grinder to afford powder.

5th Process (Blending)

A formulation comprising 80 to 90% by weight of the strands of green tea leaves as a main component, and 5 to 15% by weight of the cinnamon powder and 3 to 7% by weight of tobacco spice, both as minor components, is fed into a blender and blended.

6th Process (Secondary Drying)

The blend comprising the green tea leaves, the cinnamon powder and the tobacco spice is dried for an additional three days in a hot air blower.

7th Process (Packing)

The dried blend is delivered by a feed system to cigarette making machines called makers. At the maker, the blend is fed into hoppers which continuously allow measured amounts of filler to drop down on to prepared cigarette paper. The paper is wrapped around the tobacco blend and sealed to form continuous rods. These are then cut to proper lengths, e.g., from 83 to 125 mm. Filters are sealed to ends of cigarette rods with tipping paper. Packer machines insert cigarettes into packs which are then wrapped with cellophane sheets. Each of the cigarettes thus manufactured has the flavor of green tea leaves and cinnamon, enriched with tobacco spice.

In the third (primary drying) and the sixth process (secondary drying), green tea leaves, or a blend of green tea leaves, cinnamon and tobacco spice, are preferably dried at 190° C. using a hot air blower.

The cigarette made from the formulation comprising green tea leaves, cinnamon and tobacco spice in accordance with the third embodiment of the present invention is prepared as follows.

1st Process (for Gathering Cinnamon and Green Tea Leaves)

Bark is peeled off cinnamon trees and cut into a size from 30 to 50 mm, which is suitable for later infusion in water. Leaves are selected from green tea plants.

2nd Process (Sterilization)

The chopped cinnamon bark is sterilized by boiling in an amount of water nine times the weight of the cinnamon bark. Then, the cinnamon extract solution thus obtained is concentrated to an amount from 5 to 15% by weight based on the original weight of the solution. The sterilization of the raw green tea leaves is achieved by toasting at 200° C. or higher for 10 min or longer in a kettle without oil or water.

3rd Process (Primary Drying and Steaming)

The toasted green tea leaves are dried for three days in a hot air blower, boiled once and steamed once to reduce their odor by half or more. That is, 50% or more of the odor of green tea leaves is eliminated, along with vapor during boiling and steaming.

4th Process (Cutting)

The primarily dried green tea leaves are cut into strands, each having a size from 1 to 5 mm wide and 5 to 15 mm long, using a cutter.

5th Process (Blending)

In 5 to 15% by weight of the cinnamon extract concentrate is soaked 80 to 90% by weight of the strands of green tea leaves to infuse the ingredients and flavor of cinnamon into the green tea leaves. A formulation comprising 93 to 97% by weight of the cinnamon-soaked green tea leaves and 3 to 7% by weight of tobacco spice is fed into a blender and blended.

6th Process (Secondary Drying)

The blend comprising the green tea leaves infused with the flavor and ingredients of cinnamon and the tobacco spice is dried for an additional three days in a hot air blower.

7th Process (Packing)

The dried blend is delivered by a feed system to cigarette making machines called makers. At the maker, the blend is fed into hoppers which continuously allow measured amounts of filler to drop down on to prepared cigarette paper. The paper is wrapped around the tobacco blend and sealed to form continuous rods. These are then cut to proper lengths, e.g., from 83 to 125 mm. Filters are sealed to ends of cigarette rods with tipping paper. Packer machines insert cigarettes into packs which are then wrapped with cellophane sheets. Each of the cigarettes thus manufactured has the flavor of green tea leaves and cinnamon, enriched with tobacco spice.

In the third (primary drying) and the sixth process (secondary drying), green tea leaves, or a blend of cinnamon-infused green tea leaves and tobacco spice, are preferably dried at 190° C. using a hot air blower.

It should be understood that amounts of components in each of the formulations according to the embodiments of the present invention are represented as percentages based on the total weight of the formulation. A preferred formulation comprises 65% by weight of green tea leaves, 30% by weight of tobacco leaves and 5% by weight of tobacco spice in the first embodiment, 85% by weight of green tea leaves, 10% by weight of cinnamon powder and 5% by weight of tobacco spice in the second embodiment, and 95% by weight of the green tea leaves infused with the flavor and ingredients of cinnamon, and 5% by weight of tobacco spice in the third embodiment.

While enjoying the sweet peppery taste and flavor of cinnamon and the fresh flavor of green tea, smokers can smoothly inhale the smoke from the cigarette based on the green tea leaves supplemented with cinnamon. The combination of green tea and cinnamon makes the cigarette rich in fragrant taste characteristics. Upon burning, the cigarette smells like fragrant green tea. The smoke from the cigarette does not irritate the eyes, with an irritation level as low as 5% of that of conventional cigarettes or less. Also, the smoke of green tea leaves is reported to show antibacterial activity, aromatherapeutic activity, and repellency of noxious insects, such as mosquitoes.

As described above, the cigarettes based on green tea leaves are significantly reduced in toxicity or are mostly harmless to the body and can help cater to the various tastes of smokers.

A better understanding of the present invention may be obtained in light of the following examples which are set forth to illustrate, but are not to be construed to limit the present invention.

EXAMPLE 1

In this example, cigarettes were made from a formulation comprising green tea leaves, tobacco leaves, and tobacco spice.

First, tobacco leaves and green tea leaves gathered from farms were sterilized. Tobacco leaves were boiled twice, steamed once, and dried under the sun. Green tea leaves were toasted for about 10 min in a kettle heated to 200° C. or higher. When green tea leaves were toasted for less than 10 min, the grass odor was not removed and it was difficult to obtain the flavor of green tea. On the other hand, a toasting time period longer than 15 min drastically increased the levels of tannin and catechin in green tea leaves, thereby making the green tea leaves bitter.

Then, the tobacco leaves were primarily dried again in a sunny place until they turned brown. The green tea leaves were dried for three days in a hot air blower to control their moisture content to 13% or less. The dehydrated green tea leaves were boiled once and steamed once to reduce their odor by half or more. The primarily dried tobacco leaves and green tea leaves were cut into strands 3 mm wide and 5 mm long using a cutter.

In a blending machine, 6.5 kg of the cut green tea leaves, 3 kg of the cut tobacco leaves and 0.5 kg of hazelnut were blended for 10 min.

The resulting blend was secondarily dried for three days in a hot air blower, and 10 kg of the dried blend was delivered by a feed system to cigarette making machines. At the making machines, the blend was fed into hoppers which continuously allowed measured amounts of filler to drop down on to prepared cigarette paper. The paper was wrapped around the tobacco blend and sealed to form continuous rods. These were then cut to a size of 83 mm. Filters were sealed to ends of cigarette rods with tipping paper. Packer machines inserted cigarettes into packs which were then wrapped with cellophane sheets. As a result, 300 packs of cigarettes, each having the flavors of green tea leaves and tobacco leaves, enriched with a tobacco spice, were manufactured.

EXAMPLE 2

In this example, cigarettes were made from a formulation comprising green tea leaves, cinnamon powder, and tobacco spice.

First, bark peeled off cinnamon plants was cut into a size of 40 mm, dried in a sunny place, and ground to powder using a grinder. Green tea leaves gathered from farms were sterilized by toasting for 10 min or longer in a kettle heated to 200° C. or higher and primarily dried for three days in a hot air blower. After being boiled once for 90 min or longer and steamed once, the green tea leaves were cut into a size of 3 mm wide and 8 mm long. In a blender, 8.5 kg of the cut green tea leaves and 1 kg of the cinnamon powder were blended with 0.5 kg of tobacco spice for 10 min.

The resulting blend was secondarily dried for three days in a hot air blower, and 10 kg of the dried blend was delivered by a feed system to cigarette making machines. At the making machines, the blend was fed into hoppers which continuously allowed measured amounts of filler to drop down on to prepared cigarette paper. The paper was wrapped around the tobacco blend and sealed to form continuous rods. These were then cut to a size of 90 mm. Filters were sealed to ends of cigarette rods with tipping paper. Packer machines inserted cigarettes into packs which were then wrapped with cellophane sheets. As a result, 500 packs of cigarettes, each having the flavors of green tea leaves and cinnamon, enriched with tobacco spice, were manufactured.

EXAMPLE 3

In this embodiment, cigarettes were made from a formulation comprising cinnamon-soaked green tea leaves and tobacco spice.

First, bark peeled off cinnamon plants was cut into a size of 40 mm. 10 g of chopped cinnamon barks was boiled in 90 g of water to prepare a cinnamon extract solution. Green tea leaves were toasted for 15 min in a kettle heated to 200° C. or higher to remove grass odor therefrom and to improve the taste upon smoking, and dried for three days in a hot air blower to a moisture retention of 10% or less. Then, the green tea leaves were boiled for 90 min once and steamed once to reduce their odor by half or more. 9 kg of the cut green tea leaves was soaked in 1 kg of the cinnamon extract solution for one hour so that the flavor of cinnamon was infused into the green tea leaves. In a blender, 9.5 kg of the green tea leaves soaked in the cinnamon extract was blended with 0.5 kg of mint as a tobacco spice for 10 min.

Using a hot air blower, the resulting blend was secondarily dried for three days, and 10 kg of the dried blend was delivered by a feed system to cigarette making machines. At the making machines, the blend was fed into hoppers which continuously allowed measured amounts of filler to drop down on to prepared cigarette paper. The paper was wrapped around the tobacco blend and sealed to form continuous rods. These were then cut to a size of 90 mm. Filters were sealed to ends of cigarette rods with tipping paper. Packer machines inserted cigarettes into packs which were then wrapped with cellophane sheets. As a result, 500 packs of cigarettes, each having the flavors of green tea leaves and cinnamon, enriched with tobacco spice, were manufactured.

As described hereinbefore, the present invention provides green tea leaf-based cigarettes which are supplemented with the flavor and ingredients of tobacco leaves or cinnamon. The cigarette based on green tea leaves in combination with tobacco leaves has flavors and tastes similar to those of conventional tobacco, catering to conventional smokers' tastes. Also, green tea leaves greatly attenuate the toxicity or neutralize the toxic substances of tobacco leaves, such as nicotine, tar, etc., to almost harmless levels, in addition to providing refined flavors.

The cigarette based on green tea leaves in combination with cinnamon is almost harmless to the body thanks to its healthful components and provides sweet, peppery tastes upon burning, refreshing the smoker. The combined flavors and tastes of green tea and cinnamon are fresh to conventional smokers and can be pleasant even to non-smokers. In addition, the flavor of the green tea has the effect of deodorization as well as repellency of harmful insects, such as mosquitoes. Further, green tea plants are widely cultivated across the world, like tobacco plants, and can be readily obtained.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for manufacturing green tea-based cigarettes, comprising:

a process of gathering tobacco leaves and green tea leaves;

a sterilizing process in which the tobacco leaves are boiled twice in water, steamed once and dried under the sun, and the green tea leaves are toasted at 200° C. or higher for 10 min or longer in a kettle without oil or water;

a primary drying process in which the sterilized tobacco leaves are dried in a sunny place until they turn brown, and the toasted green tea leaves are dried for three days in a hot air blower, boiled once and steamed once to reduce their odor by half or more;

a cutting process in which the primarily dried tobacco leaves and green tea leaves are cut into strands, each having a size from 1 to 5 mm wide and 5 to 15 mm long, using respective cutters;

a blending process in which the strands of green tea leaves as a main component, the strands of tobacco leaves as a minor component, and tobacco spice as a minor component, are fed into a blender and blended for 10 min or longer;

a secondary drying process in which the blend comprising the green tea leaves, the tobacco leaves and the tobacco spice is dried for an additional three days in a hot air blower to produce a dried blend; and a packing process in which measured amounts of the dried blend are wrapped with cigarette paper.

2. A method for manufacturing green tea-based cigarettes, comprising:

a gathering process in which bark peeled off cinnamon trees is cut into a size from 30 to 50 mm and leaves are selected from green tea plants;

a sterilizing process in which the cinnamon bark is dried under the sun and the raw green tea leaves are toasted at 200° C. or higher for 10 min or longer;

a primary drying process in which the sterilized cinnamon is dehydrated in a sunny place to a moisture content of 13% or less and the toasted green tea leaves are dried for three days in a hot air blower, boiled once and steamed once to reduce their odor by half or more;

a cutting and grinding process in which the primarily dried green tea leaves are cut into strands, each having a size from 1 to 5 mm wide and 5 to 15 mm long, using a cutter, and the primarily dried cinnamon bark is ground using a grinder to afford powder;

a blending process in which 80 to 90% by weight of the strands of green tea leaves, 5 to 15% by weight of the cinnamon powder, and 3 to 7% by weight of tobacco spice are blended in a blender;

a secondary drying process in which the blend comprising the green tea leaves, the cinnamon powder and the tobacco spice is dried for an additional three days in a hot air blower; and a packing process in which the dried blend is delivered by a feed system to cigarette making machines, fed into hoppers which continuously allow measured amounts of filler to drop down on to prepared cigarette paper, and wrapped with the paper to form continuous rods which are then cut to proper lengths from 83 to 125 mm, filters are sealed to ends of cigarette rods with tipping paper, and packer machines insert cigarettes into packs which are then wrapped with cellophane sheets.

3. A method for manufacturing green tea-based cigarettes, comprising:

a gathering process in which bark peeled off cinnamon trees is cut into a size from 30 to 50 mm and leaves are selected from green tea plants;

a sterilizing process in which a mixture of 10% by weight of the cinnamon bark strips and 90% by weight of water is boiled to produce an extract concentrate whose total amount is 5 to 15% by weight of the mixture, and the raw green tea leaves are toasted at 200° C. or higher for 10 min or longer in a kettle;

a primary drying and steaming process in which the toasted green tea leaves are dried for three days in a hot air blower, boiled once and steamed once to reduce their odor by half or more;

a cutting process in which the primarily dried green tea leaves are cut into strands, each having a size from 1 to 5 mm wide and 5 to 15 mm long, using a cutter;

a blending process in which 80 to 90% by weight of the strands of green tea leaves is soaked in 5 to 15% by weight of the cinnamon extract concentrate to infuse the ingredients and flavor of cinnamon into the green tea leaves, and a formulation comprising 93 to 97% by weight of the cinnamon-soaked green tea leaves and 3 to 7% by weight of tobacco spice is fed into a blender and blended;

a secondary drying process in which the blend comprising the green tea leaves infused with the flavor and ingredients of cinnamon and the tobacco spice is dried for an additional three days in a hot air blower;

a packing process in which the dried blend is delivered by a feed system to cigarette making machines, fed into hoppers which continuously allow measured amounts of filler to drop down on to prepared cigarette paper, and wrapped with the paper to form continuous rods which are then cut to proper lengths from 83 to 125 mm, filters are sealed to ends of cigarette rods with tipping paper, and packer machines insert cigarettes into packs which are then wrapped with cellophane sheets.

4. A green tea based cigarette manufactured in accordance with the method of claim 1.

5. A method for manufacturing a green tea-based cigarette in accordance with claim 1 wherein the blending process employs between 60 to 70% by weight of the strands of green tea leaves as a main component.

6. A method for manufacturing a green tea-based cigarette in accordance with claim 5 wherein the blending process employs between 25 to 35% by weight of the strands of tobacco leaves.

7. A method for manufacturing a green tea-based cigarette in accordance with claim 6 wherein the blending process employs between 3 to 7% by weight of tobacco spice.

8. A method for manufacturing a green tea-based cigarette in accordance with claim 1 wherein in the packing process, measured amounts of the dried blend are delivered by a feed system to cigarette making machines, fed into hoppers which continuously allow measured amounts of filler to drop down on to prepared cigarette paper, and wrapped with the paper to form continuous rods which are then cut to proper lengths from 83 to 125 mm, filters are sealed to ends of cigarette rods with tipping paper, and packer machines insert cigarettes into packs.

9. A green tea-based cigarette manufactured in accordance with claim 7.

10. A pack of green tea-based cigarettes manufactured in accordance with claim 8.

11. A method for manufacturing a green tea-based cigarette in accordance with claim 1 wherein in the tobacco spice is selected from the group consisting of hazelnut, mint, cacao, tobacco and combinations of two or more thereof.

* * * * *